US010746191B2

(12) United States Patent
Fukuyama et al.

(10) Patent No.: US 10,746,191 B2
(45) Date of Patent: Aug. 18, 2020

(54) CENTRIFUGAL COMPRESSOR

(71) Applicant: KABUSHIKI KAISHA TOYOTA JIDOSHOKKI, Aichi-ken (JP)

(72) Inventors: Ryosuke Fukuyama, Kariya (JP); Satoru Mitsuda, Kariya (JP); Hiroaki Kato, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 110 days.

(21) Appl. No.: 15/925,098

(22) Filed: Mar. 19, 2018

(65) Prior Publication Data

US 2018/0283393 A1 Oct. 4, 2018

(30) Foreign Application Priority Data

Mar. 31, 2017 (JP) ..... 2017-071650

(51) Int. Cl.

| | |
|---|---|
| ***F04D 29/059*** | (2006.01) |
| ***F04D 25/02*** | (2006.01) |
| ***F04D 29/063*** | (2006.01) |
| ***F04D 29/44*** | (2006.01) |
| ***F04D 29/40*** | (2006.01) |

(Continued)

(52) U.S. Cl.

CPC ..... *F04D 29/063* (2013.01); *F04D 25/028* (2013.01); *F04D 25/0606* (2013.01); *F04D 29/059* (2013.01); *F04D 29/102* (2013.01); *F04D 29/403* (2013.01); *F04D 29/441* (2013.01)

(58) Field of Classification Search

CPC .. F04B 27/109; F04C 18/356; F04C 18/3562; F04C 18/3564; F04D 25/02; F04D 25/028; F04D 25/0606; F04D 29/054; F04D 29/059; F04D 29/063; F04D 29/102; F04D 29/104; F04D 29/122; F04D 29/403; F04D 29/4206; F04D 29/441; F16H 13/00; F16H 13/06; F16H 13/08; F16H 57/04; F16H 57/0456; F16C 35/00; F16C 35/04; F16C 35/06; F05D 2260/40311; F05D 2260/98

USPC ..... 416/170 R

See application file for complete search history.

(56) References Cited

U.S. PATENT DOCUMENTS

| | | | | |
|---|---|---|---|---|
| 4,249,784 | A * | 2/1981 | Ichikawa | F16C 19/50 384/494 |
| 2003/0121507 | A1* | 7/2003 | Hasegawa | F01D 5/026 123/559.3 |
| 2015/0260194 | A1* | 9/2015 | Kagami | F04D 25/045 415/122.1 |

FOREIGN PATENT DOCUMENTS

| | | |
|---|---|---|
| JP | 2005-140306 | 6/2005 |
| JP | 2006-009936 | 1/2006 |

(Continued)

*Primary Examiner* — Woody A Lee, Jr.
*Assistant Examiner* — Justin A Pruitt
(74) *Attorney, Agent, or Firm* — Greenblum & Bernstein, P.L.C.

(57) ABSTRACT

A centrifugal compressor includes a housing, a partition separating an empty space in a housing into a speed increaser chamber and an impeller chamber, an insertion hole provided in the partition to allow insertion of a high-speed shaft, a seal located in the insertion hole to seal a boundary between the partition and the high-speed shaft, and a bearing receptacle located in the partition. The partition includes a communication passage that allows communication between a portion of the insertion hole located closer to the speed increaser chamber than the seal and the bearing receptacle.

9 Claims, 4 Drawing Sheets

(51) Int. Cl.
*F04D 29/10* (2006.01)
*F04D 25/06* (2006.01)

(56) References Cited

FOREIGN PATENT DOCUMENTS

| | | |
|---|---|---|
| JP | 2015-140682 | 8/2015 |
| JP | 2016-194251 | 11/2016 |

* cited by examiner

CENTRIFUGAL COMPRESSOR

BACKGROUND ART

The present invention relates to a centrifugal compressor.

Japanese Laid-Open Patent Publication No. 2016-194251 describes an example of a centrifugal compressor including a speed increaser. The centrifugal compressor includes a housing and a partition separating the empty space in the housing into an impeller chamber and a speed increaser chamber. The speed increaser chamber accommodates a speed increasing mechanism. The impeller chamber accommodates an impeller. The speed increasing mechanism includes a ring member, a high-speed shaft, and rollers. The ring member is rotated by rotation of a low-speed shaft. The high-speed shaft is located at the inner side of the ring member. The rollers are located between the ring member and the high-speed shaft in contact with both the ring member and the high-speed shaft. Each of the rollers is supported by roller bearings. The roller bearings are accommodated in bearing receptacles located in the partition. The speed increasing mechanism is supplied with oil for lubricating the rollers.

Each of the rollers covers an axial end surface of the corresponding roller bearing supporting the roller. Thus, each of the rollers may block the supply of oil to the corresponding roller bearing.

SUMMARY

It is an object of the present invention to provide a centrifugal compressor that limits a shortage of supply of oil to roller bearings supporting rollers.

To achieve the above object, a centrifugal compressor includes a housing, a ring member, a high-speed shaft, a plurality of rollers, an impeller, a partition, an insertion hole, a seal, an oil supply passage, a plurality of pairs of roller bearings, and a plurality of bearing receptacles. The ring member is accommodated in the housing. The ring member rotates in accordance with rotation of a low-speed shaft and includes a circumferential wall. The high-speed shaft is located at an inner side of the circumferential wall. The rollers are located between the circumferential wall and the high-speed shaft. The impeller rotates integrally with the high-speed shaft. The partition separates an empty space in the housing into a speed increaser chamber and an impeller chamber. The speed increaser chamber accommodates the ring member and the rollers. The impeller chamber accommodates the impeller. The insertion hole is provided in the partition. The high-speed shaft is inserted through the insertion hole. The seal is located in the insertion hole to seal a boundary between the partition and the high-speed shaft. The oil supply passage is located in the housing and has one end open in the insertion hole. Each pair of the roller bearings supports two axial ends of a corresponding one of the rollers. The bearing receptacles are located in the partition. Each of the bearing receptacles accommodates one of a corresponding pair of the roller bearings. The partition includes a communication passage that allows communication between a portion of the insertion hole located closer to the speed increaser chamber than the seal and the bearing receptacles.

BRIEF DESCRIPTION OF THE DRAWINGS

The embodiments, together with objects and advantages thereof, may best be understood by reference to the following description of the presently preferred embodiments together with the accompanying drawings in which.

DESCRIPTION OF THE EMBODIMENTS

One embodiment of a centrifugal compressor will now be described. The centrifugal compressor of the present embodiment includes a speed increaser and is installed in a fuel cell vehicle (FCV) that is powered by a fuel cell. The centrifugal compressor supplies the fuel cell with air.

Figure 1:
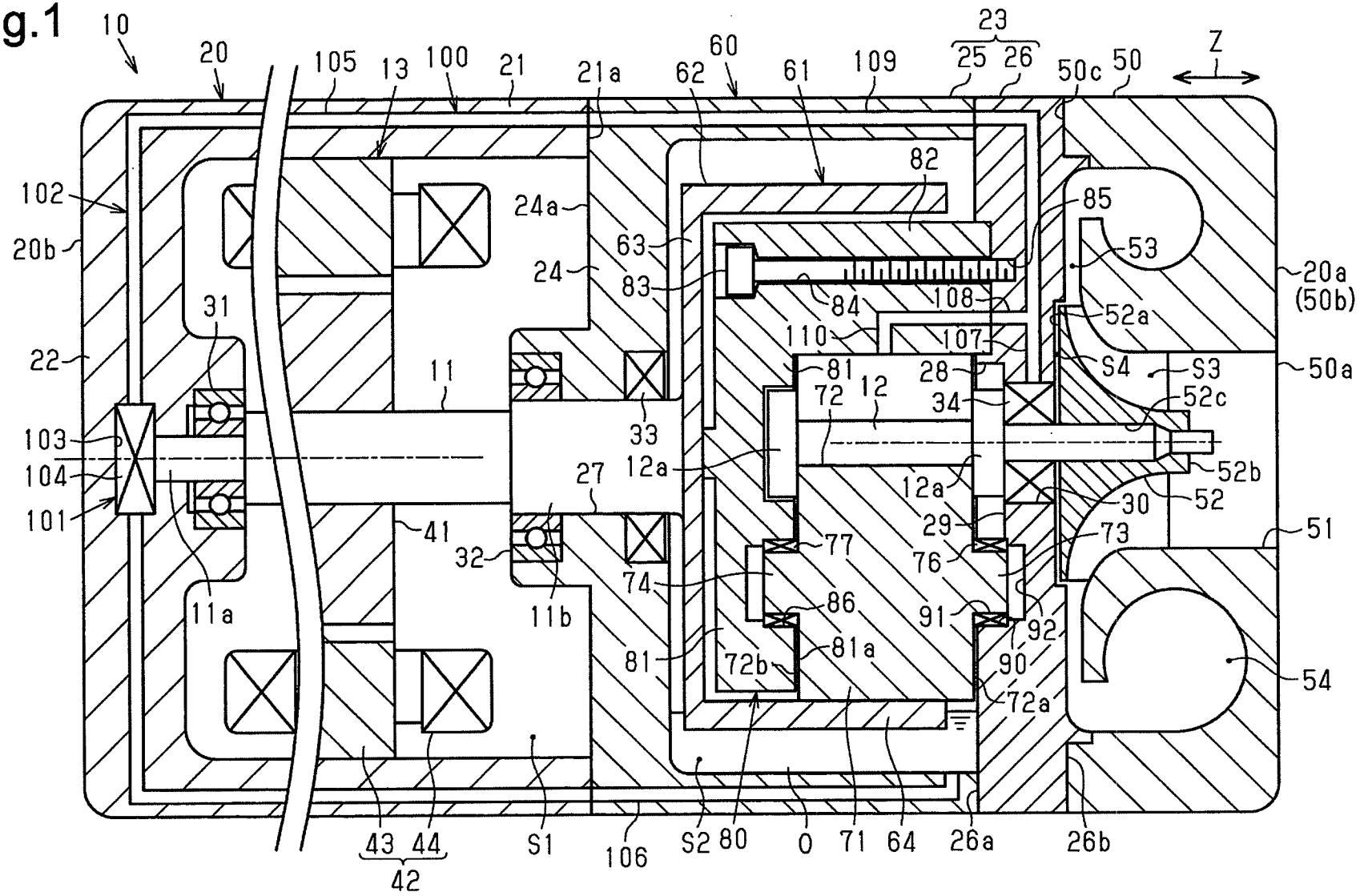
FIG. 1 is a schematic cross-sectional view of a centrifugal compressor.

As shown in FIG. 1, a centrifugal compressor 10 includes a low-speed shaft 11, a high-speed shaft 12, an electric motor 13 that rotates the low-speed shaft 11, a speed increaser 60, and an impeller 52. The speed increaser 60 increases the rotation speed of the low-speed shaft 11 and transmits the rotation to the high-speed shaft 12. The impeller 52 is rotated by the high-speed shaft 12 to compress fluid (air in the present embodiment). The high-speed shaft 12 includes two flanges 12*a* spaced apart and opposed to each other in the axial direction of the high-speed shaft 12. The two shafts 11 and 12 are formed from, for example, a metal, specifically, iron or an iron alloy.

The centrifugal compressor 10 includes a housing 20 that forms the outer shell of the centrifugal compressor 10. The housing 20 accommodates the two shafts 11 and 12, the electric motor 13, and a speed increasing mechanism 61 that forms part of the speed increaser 60. The housing 20 is, for example, substantially tubular (specifically, cylindrical) as a whole.

The housing 20 includes a motor housing member 21 that accommodates the electric motor 13, a speed increaser housing member 23 that accommodates the speed increasing mechanism 61, and a compressor housing member 50 including a suction port 50*a* that draws in fluid. Among the two end surfaces 20*a* and 20*b* of the housing 20 in the axial direction, the suction port 50*a* is located in the first end surface 20*a*. The compressor housing member 50, the speed increaser housing member 23, and the motor housing member 21 are aligned in this order from the side closer to the suction port 50*a* in the axial direction of the housing 20. In the present embodiment, the speed increasing mechanism 61 and the speed increaser housing member 23 form the speed increaser 60.

The motor housing member 21 is tubular (specifically, cylindrical) as a whole and includes a closed end 22 (end wall). The second end surface 20*b* defines the outer surface of the closed end 22 of the motor housing member 21 and is located at the side of the housing 20 opposite to the first end surface 20*a*, which includes the suction port 50*a*. The speed increaser housing member 23 includes a main body 25 and a cover 26. The main body 25 is tubular (specifically, cylindrical) and includes a closed end 24 (end wall). The cover 26 is located at the side opposite to the closed end 24 in the axial direction of the main body 25.

The motor housing member 21 and the speed increaser housing member 23 are coupled to each other with the open end of the motor housing member 21 joined with the closed end 24 of the main body 25. The closed end 24 has an end surface 24*a* covered by the motor housing member 21. The inner surface of the motor housing member 21 and the end surface 24*a* define a motor accommodation chamber S1. The motor accommodation chamber S1 accommodates the electric motor 13. Further, the motor accommodation chamber S1 accommodates the low-speed shaft 11 in a state in which the low-speed shaft 11 is coaxial with the housing 20.

The low-speed shaft 11 is supported by the housing 20 in a rotatable manner. The centrifugal compressor 10 includes a first bearing 31. The first bearing 31 is arranged in the closed end 22 of the motor housing member 21. The low-speed shaft 11 includes a first end 11*a* supported by the first bearing 31. Part of the first end 11*a* is inserted through the first bearing 31 and fitted into the closed end 22 of the motor housing member 21.

The closed end 24 of the main body 25 includes an insertion hole 27 that is slightly larger than a second end lib of the low-speed shaft 11 located at the side opposite to the first end 11*a*. The centrifugal compressor 10 includes a second bearing 32, which is located in the insertion hole 27, and a motor seal 33. The second end 11*b* of the low-speed shaft 11 is supported by the second bearing 32. The motor seal 33 restricts the leakage of oil O from the speed increaser housing member 23 to the motor accommodation chamber S1.

The second end 11*b* of the low-speed shaft 11 is inserted into the insertion hole 27 of the main body 25. Part of the low-speed shaft 11 is located in the speed increaser housing member 23.

The electric motor 13 includes a rotor 41 that is fixed to the low-speed shaft 11 and a stator 42 that is located at the radially outer side of the rotor 41. The stator 42 is fixed to the inner surface of the motor housing member 21. The stator 42 includes a cylindrical stator core 43 and a coil 44 wound around the stator core 43. The rotor 41 and the low-speed shaft 11 rotate integrally when current flows to the coil 44.

The cover 26 is, for example, disk-shaped and has the same diameter as the speed increaser housing member 23. The two sides of the cover 26 in the axial direction respectively define first and second plate surfaces 26*a* and 26*b*. The speed increaser housing member 23 is assembled by joining the open end of the main body 25 with the first plate surface 26*a*. The first plate surface 26*a* of the cover 26 and the inner surface of the speed increaser housing member 23 define a speed increaser chamber S2. The speed increaser chamber S2 accommodates the speed increasing mechanism 61.

The cover 26, which forms the speed increaser housing member 23, includes an insertion hole 28 that allows for insertion of the high-speed shaft 12, which forms part of the speed increasing mechanism 61. The insertion hole 28 includes a large diameter portion 29 and a small diameter portion 30 having a smaller diameter than the large diameter portion 29. The large diameter portion 29 is open in the first plate surface 26*a*. The small diameter portion 30 is open in the second plate surface 26*b*. One of the flanges 12*a* of the high-speed shaft 12 is located in the large diameter portion 29. Part of the high-speed shaft 12 is inserted through the insertion hole 28 and located in the compressor housing member 50.

The centrifugal compressor 10 includes a seal 34 located between the wall surface of the insertion hole 28 and the high-speed shaft 12 to seal the boundary of the wall surface of the insertion hole 28 and the high-speed shaft 12. The seal 34 restricts the leakage of the oil O from the speed increaser housing member 23 into the compressor housing member 50. The seal 34 is located in the small diameter portion 30. A mechanical seal is used as the seal member 34 of the present embodiment.

The compressor housing member 50 is substantially tubular and includes a through hole 51 that extends through the compressor housing member 50 in the axial direction. The two axial ends of the compressor housing member 50 respectively define a first end surface 50*b* and a second end surface 50*c*. The first end surface 50*b* of the compressor housing member 50 defines the first end surface 20*a* of the housing 20. The through hole 51 opens in the first end surface 50*b* and functions as the suction port 50*a*.

The compressor housing member 50 and the cover 26 are coupled to each other with the second end surface 50*c* joined with the second plate surface 26*b*. The second end surface 50*c* is the end surface of the compressor housing member 50 at the side opposite to the first end surface 50*b*, and the second plate surface 26*b* is the end surface of the cover 26 at the side opposite to the first plate surface 26*a*. The wall surface of the through hole 51 and the second plate surface 26*b* of the cover 26 define an impeller chamber S3. The impeller chamber S3 accommodates the impeller 52. The through hole 51 functions as the suction port 50*a* and defines the impeller chamber S3. The suction port 50*a* is in communication with the impeller chamber S3. The cover 26 located between the speed increaser chamber S2 and the impeller chamber S3 corresponds to a partition separating the two chambers S2 and S3 from each other.

The through hole 51 has a diameter that is constant from the suction port 50*a* to an intermediate position in the axial direction. The through hole 51 from the intermediate position has the form of a substantially truncated cone of which the diameter gradually increases toward the cover 26. Thus, the impeller chamber S3 defined by the wall surface of the through hole 51 substantially has the form of a truncated cone.

The impeller 52 has a contour that is gradually reduced in diameter from the basal end surface 52*a* toward the distal end surface 52*b*. The impeller 52 includes a shaft insertion hole 52*c* that extends in the axial direction of the impeller 52 and allows for insertion of the high-speed shaft 12. The impeller 52 is coupled to the high-speed shaft 12 with part of the high-speed shaft 12 inserted through the shaft insertion hole 52*c* and projected into the through hole 51. The impeller 52 is rotated integrally with the high-speed shaft 12. The basal end surface 52*a* of the impeller 52 and the second plate surface 26*b* of the cover 26 define a rear surface region S4. The rotation of the high-speed shaft 12 rotates the impeller 52 and compresses the fluid drawn through the suction port 50*a*.

Further, the centrifugal compressor 10 includes a diffuser passage 53 and a discharge chamber 54. The fluid compressed by the impeller 52 flows into the diffuser passage 53. The fluid that passes through the diffuser passage 53 enters the discharge chamber 54. The through hole 51 includes an open end that opens toward the second plate surface 26*b* of the cover 26 and is continuous with the diffuser passage 53. The diffuser passage 53 is defined by the second plate surface 26*b* and the surface of the compressor housing member 50 opposing the second plate surface 26*b*. The diffuser passage 53 is located outward from the impeller chamber S3 in the radial direction of the high-speed shaft 12 and has a closed shape (specifically, circular shape) so as to surround the impeller 52 and the impeller chamber S3. The discharge chamber 54 has a closed shape and is located outward from the diffuser passage 53 in the radial direction of the high-speed shaft 12. The impeller chamber S3 is in communication with the discharge chamber 54 through the diffuser passage 53. The fluid compressed by the impeller 52 is further compressed in the diffuser passage 53 and then discharged out of the discharge chamber 54.

The speed increaser 60 will now be described. The speed increaser 60 of the present embodiment is of a traction drive type (friction roller type).

The speed increasing mechanism 61 of the speed increaser 60 includes a ring member 62 that is coupled to the second end 11*b* of the low-speed shaft 11. The ring member 62 includes a disk-shaped base 63 and a circumferential wall 64. The base 63 is coupled to the second end 11*b* of the low-speed shaft 11, and the circumferential wall 64 is ring-shaped and extends in the axial direction from the circumferential edge of the base 63. The circumferential wall 64 has an inner diameter that is larger than the diameter of the second end 11*b* of the low-speed shaft 11.

In the present embodiment, the ring member 62 is coupled to the low-speed shaft 11 in a state in which the base 63 (ring member 62) is coaxial with the low-speed shaft 11. The circumferential wall 64 is also coaxial with the low-speed shaft 11. The rotation of the low-speed shaft 11 rotates the ring member 62.

Part of the high-speed shaft 12 is located at the inner side of the circumferential wall 64 in the radial direction of the ring member 62. The speed increasing mechanism 61 includes three rollers 71 located between the high-speed shaft 12 and the circumferential wall 64 in contact with both the circumferential wall 64 and the high-speed shaft 12.

Figure 2:
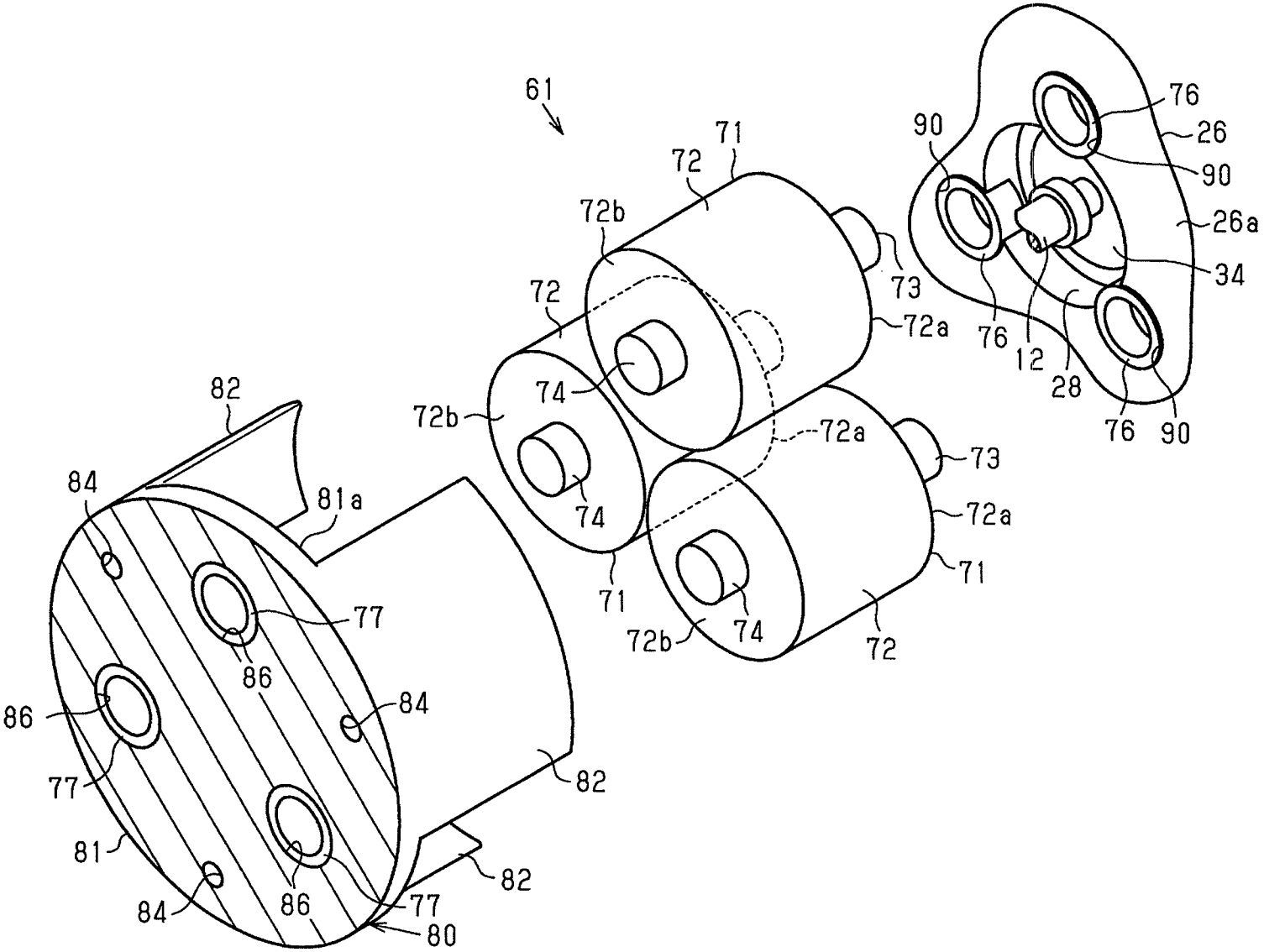
FIG. 2 is a partially perspective view of a speed increasing mechanism.
Figure 3:
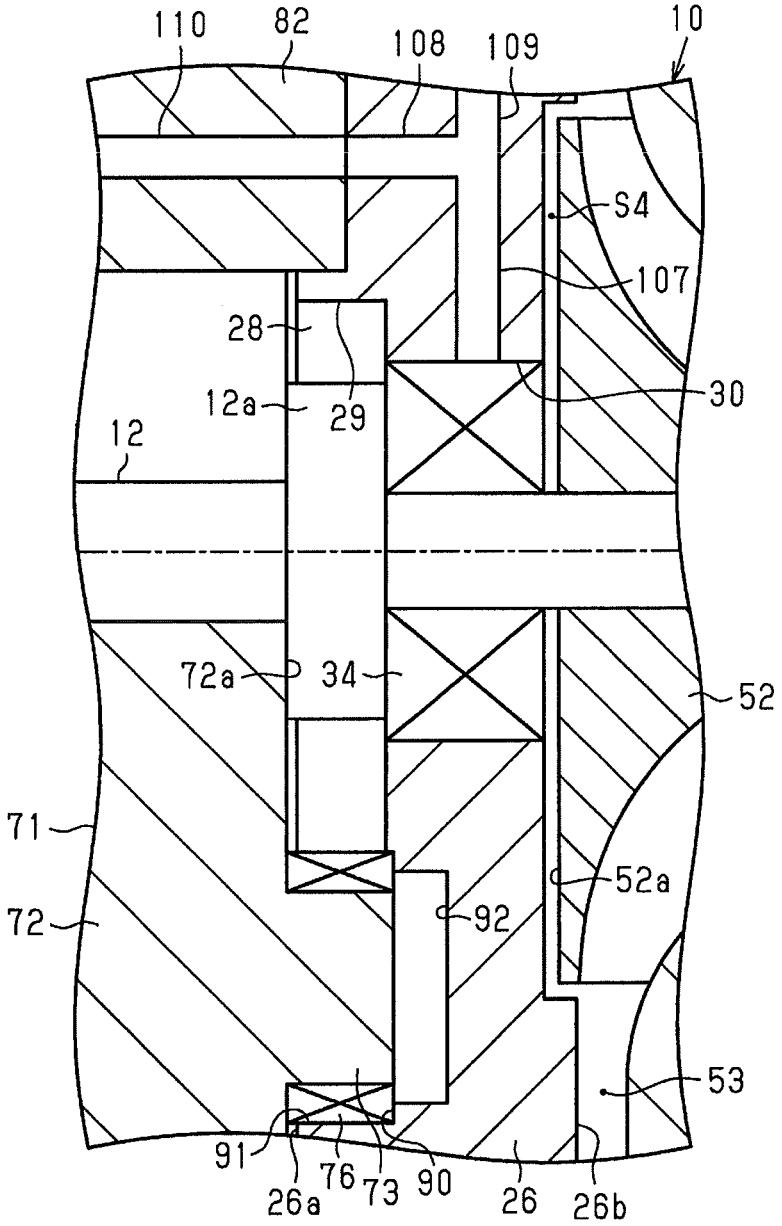
FIG. 3 is a partially enlarged cross-sectional view of a speed increaser.

As shown in FIGS. 2 and 3, the three rollers 71 are identically shaped. The rollers 71 each include a cylindrical roller portion 72, first and second end surfaces 72*a* and 72*b* in the axial direction of the roller portion 72, a cylindrical first projection 73 that projects from the first end surface 72*a*, and a cylindrical second projection 74 that projects from the second end surface 72*b*. The roller portion 72 is coaxial with the first projection 73 and the second projection 74. The axial direction of the roller portion 72 will hereinafter be referred to as the axial direction Z of the rollers 71.

The roller portion 72 has a diameter (length in direction orthogonal to axial direction Z) that is larger than that of the high-speed shaft 12. The axial direction Z coincides with the rotation axis of the high-speed shaft 12. The rollers 71 are arranged in the circumferential direction of the high-speed shaft 12 spaced apart from one another. The rollers 71 are each formed from, for example, a metal. More specifically, the rollers 71 are formed from the same metal as the high-speed shaft 12, for example, iron or an iron alloy.

Figure 4:
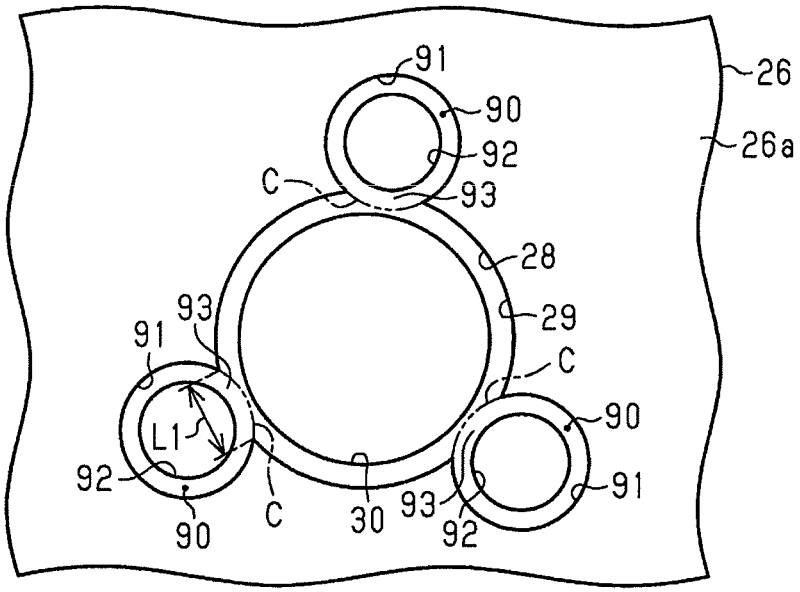
FIG. 4 is a diagram showing the relationship between bearing receptacles and an insertion hole.

As shown in FIGS. 2 and 4, the speed increasing mechanism 61 includes a support 80. The support 80 cooperates with the cover 26 to support the rollers 71 so that the rollers 71 are rotatable. The support 80 is located at the inner side the circumferential wall 64. The support 80 includes a disk-shaped support base 81 that is slightly smaller in diameter than the circumferential wall 64 and three posts 82 that extend in the axial direction from the support base 81. The support base 81 is opposed to the cover 26 in the axial direction Z. The support base 81 includes an opposing plate surface 81*a* that is opposed to the first plate surface 26*a* of the cover 26. The three posts 82 extend from the opposing plate surface 81*a* toward the cover 26 filling three gaps that are each defined between the inner circumferential surface of the circumferential wall 64 and the outer circumferential surfaces of two adjacent ones of the roller portions 72.

As shown in FIGS. 1 and 2, the support 80 includes bolt holes 84, each of which extends through the corresponding post 82 and allows for insertion of a bolt 83. The cover 26 includes threaded holes 85 corresponding to the bolt holes 84. Each bolt hole 84 is in communication with the corresponding threaded hole 85. In a state in which the distal end surfaces of the posts 82 are joined with the first plate surface 26*a*, the posts 82 are fixed to the cover 26 by inserting each bolt 83 through the corresponding bolt hole 84 and fastening the bolt 83 to the corresponding threaded hole 85.

The speed increaser 60 includes three pairs of first roller bearings 76 and second roller bearings 77 in which each pair of the first roller bearings 76 and second roller bearings 77 supports corresponding one of the rollers 71 in a rotatable manner. The first roller bearings 76 are arranged in the cover 26. The second roller bearings 77 are arranged in the support base 81. The rollers 71 are supported by the first roller bearings 76 and the second roller bearings 77 so as to be held between the cover 26 and the support base 81.

More specifically, as shown in FIGS. 3 and 4, the cover 26 includes three bearing receptacles 90 recessed from the first plate surface 26*a* in the thickness-wise direction. Each bearing receptacle 90 accommodates the corresponding first roller bearing 76. The bearing receptacles 90 are arranged in the circumferential direction of the cover 26, or the circumferential direction of the high-speed shaft 12, about the insertion hole 28. The interval of adjacent ones of the bearing receptacles 90 in the circumferential direction of the cover 26 is set in conformance with the interval of the corresponding rollers 71.

The bearing receptacles 90 are in communication with the large diameter portion 29 of the insertion hole 28. In the present embodiment, the bearing receptacles 90 are continuously connected to the large diameter portion 29 of the insertion hole 28. More specifically, the bearing receptacles 90 are directly connected to the insertion hole 28 without any other gaps located in between in the radial direction of the high-speed shaft 12. The seal 34 is located in the small diameter portion 30, and the bearing receptacles 90 are in communication with the large diameter portion 29. Thus, the bearing receptacles 90 are in communication with portions of the insertion hole 28 that are located closer to the speed increaser chamber S2 than the seal 34.

Each bearing receptacle 90 is defined by an arcuate wall surface 91. The continuous connection of the bearing receptacles 90 to the large diameter portion 29 of the insertion hole 28 partially interrupts the wall surfaces 91. As indicated by the double-dashed lines in FIG. 4, each circle C including the arc of the wall surface 91 has a slightly larger diameter than the first roller bearings 76. In other words, the wall surface 91 has the form of a circle that is partially cut away.

The interrupted parts of each wall surface 91 are connected to each other at a border 93 of the bearing receptacle 90 and the insertion hole 28 by a dimension L1 with the minimum distance. The dimension L1 is smaller than the diameter of the first roller bearing 76. This restricts removal of the first roller bearing 76 into the insertion hole 28 caused by the communication of the bearing receptacle 90 and the insertion hole 28. The border 93 of each bearing receptacle 90 and the insertion hole 28 corresponds to a communication passage that allows communication between the bearing receptacle 90 and the insertion hole 28.

When the bearing receptacles 90 accommodate the first roller bearings 76, the first roller bearings 76 partially project from the borders 93 to the large diameter portion 29 in the radial direction and are located in the large diameter portion 29.

The cover 26 includes recesses 92 recessed from the bottom of each bearing receptacle 90 in the thickness-wise direction. Each recess 92 is circular as viewed in the axial direction Z. The recess 92 has a smaller diameter than the first roller bearings 76. The axial direction of the recess 92 coincides with the axial direction of the bearing receptacle 90.

As described above, the flange 12*a* of the high-speed shaft 12 is located in the large diameter portion 29. The bearing receptacles 90 and the first roller bearings 76, which are accommodated in the bearing receptacles 90, are opposed to the flange 12*a* in the radial direction of the high-speed shaft 12. The bearing receptacles 90 and the first roller bearings 76, which are accommodated in the bearing receptacles 90, are not opposed to the seal 34, which is located in the small diameter portion 30, in the radial direction of the high-speed shaft 12.

As shown in FIGS. 1 and 2, the support base 81 includes three support receptacles 86 recessed from the opposing plate surface 81*a* in the thickness-wise direction. Each support receptacle 86 is opposed to the corresponding bearing receptacle 90 in the axial direction Z. The support receptacle 86 is circular as viewed in the axial direction Z. The support receptacle 86 has a slightly larger diameter than the second roller bearings 77. The support receptacle 86 accommodates the corresponding second roller bearing 77.

The first projection 73 of each roller 71 is inserted into the corresponding first roller bearing 76. The second projection 74 of the roller 71 is inserted into the corresponding second roller bearing 77. Thus, the rollers 71 are supported in a rotatable manner.

The rollers 71, the ring member 62, and the high-speed shaft 12 form a unit with each roller portion 72 forced against the high-speed shaft 12 and the circumferential wall 64. The high-speed shaft 12 is supported by the three roller portions 72 in a rotatable manner. A pressing load is applied to the location where the outer circumferential surface of each roller portion 72 contacts the inner circumferential surface of the circumferential wall 64 and the location where the outer circumferential surface of each roller portion 72 contacts the circumferential surface of the high-speed shaft 12.

As shown in FIG. 1, each roller portion 72 is held between the two flanges 12*a* in the axial direction. This restricts displacement of the high-speed shaft 12 and the roller portions 72 in the axial direction Z of the high-speed shaft 12.

The centrifugal compressor 10 includes an oil supplying mechanism 100 that supplies the oil O to the speed increasing mechanism 61. The oil supplying mechanism 100 includes a pump 101 and an oil passage 102. The pump 101 is driven so that the oil O circulates through the oil passage 102 and flows to the speed increaser chamber S2.

The pump 101 is arranged in the closed end 22 of the motor housing member 21. The pump 101 of the present embodiment is of a displacement type. The pump 101 includes an accommodation portion 103, which is located in the closed end 22, and a rotation body 104. The first end 11*a* of the low-speed shaft 11 is coupled to the rotation body 104.

The housing 20 includes a supply passage 105 forming part of the oil passage 102 and a circulation passage 106 forming part of the oil passage 102. The supply passage 105 and the circulation passage 106 are defined in the inner wall of the housing 20. The supply passage 105 includes an oil conduit 109, a first branch conduit 107, and a second branch conduit 108. One end of the oil conduit 109 is in communication with the accommodation portion 103. The other end of the oil conduit 109 branches into the first branch conduit 107 and the second branch conduit 108. One end of the first branch conduit 107 is open in the insertion hole 28. The other end of the first branch conduit 107 is open in the point where the first branch conduit 107 and the second branch conduit 108 branch.

At least one of the posts 82 includes a speed increaser side supply passage 110 that forms part of the oil passage 102. One end of the speed increaser side supply passage 110 is open in the second branch conduit 108 and in communication with the second branch conduit 108. The other end of the speed increaser side supply passage 110 is open in an end surface of the post 82 at a position opposing the corresponding roller portion 72.

The circulation passage 106 connects the accommodation portion 103 and the speed increaser chamber S2. The centrifugal compressor 10 is used with the portion of the speed increaser housing member 23 that is in communication with the circulation passage 106 located at the lower side in the vertical direction. Thus, gravitational force stores the oil O in the portion of the speed increaser housing member 23 that is in communication with the circulation passage 106.

When the pump 101 is driven, the oil O sequentially flows through the circulation passage 106, the accommodation portion 103, and the supply passage 105 and is supplied from the first branch conduit 107 to the seal 34. Also, the oil O that is supplied from the second branch conduit 108 to the speed increaser side supply passage 110 is supplied to the speed increasing mechanism 61 (rollers 71). The first branch conduit 107 corresponds to an oil supply passage that supplies the oil O to the seal 34.

With the above structure, when the rollers 71 are rotated, the circumferential surfaces of the roller portions 72 contact the inner circumferential surface of the circumferential wall 64 with a thin film of the oil O located in between. In the same manner, the circumferential surface of the high-speed shaft 12 contacts the circumferential surfaces of the roller portions 72 with a thin film of the oil O that is solidified located in between. The rotational force of the rollers 71 is transmitted to the high-speed shaft 12 via the thin film of the solidified oil O, which is formed between the circumferential surface of the high-speed shaft 12 and the circumferential surfaces of the roller portions 72, and consequently rotates the high-speed shaft 12. The circumferential wall 64 rotates at the same speed as the low-speed shaft 11. Each roller 71 rotates at a higher speed than the low-speed shaft 11. Further, the high-speed shaft 12, which has a smaller diameter than the roller portions 72, rotates at a higher speed than the roller portions 72. In this manner, the speed increaser 60 rotates the high-speed shaft 12 at a higher speed than the low-speed shaft 11.

The operation of the centrifugal compressor 10 of the present embodiment will now be described.

When the electric motor 13 is driven, the low-speed shaft 11 is rotated to drive the pump 101. The second branch conduit 108 supplies the oil O to the speed increasing mechanism 61, and the first branch conduit 107 supplies the oil O to the seal 34. The rollers 71 cover the axial end surfaces of the first roller bearings 76. This hinders the oil O supplied from the speed increaser side supply passage 110 from reaching the first roller bearings 76.

The oil O supplied from the first branch conduit 107 to the seal 34 flows into the insertion hole 28 toward the speed increaser chamber S2 from the seal 34, that is, toward the large diameter portion 29. As the high-speed shaft 12 rotates, the centrifugal force of the high-speed shaft 12 urges the oil O to the radially outer side of the large diameter portion 29. Because the large diameter portion 29 is in communication with the bearing receptacles 90, the oil O that flows to the large diameter portion 29 is supplied to the bearing receptacles 90. Thus, the first roller bearings 76 are supplied with the oil O.

In the centrifugal compressor 10, to avoid contact of the basal end surface 52*a* of the impeller 52 with the cover 26, the rear surface region S4 is defined between the basal end surface 52*a* of the impeller 52 and the cover 26. A fluid that is compressed by the impeller 52 enters the rear surface region S4. The compressed fluid pushes the impeller 52 toward the suction port 50*a*. Thrust force directed from the speed increaser chamber S2 toward the impeller chamber S3 acts on the high-speed shaft 12. The thrust force is transmitted to the rollers 71 via one of the two flanges 12*a* of the high-speed shaft 12 that is opposed to the second end surfaces 72*b* of the roller portions 72. The thrust force is applied from the rollers 71 to the first roller bearings 76. The first roller bearings 76 tend to produce heat as compared to the second roller bearings 77, however, the oil O is easily supplied to the first roller bearings 76 and limits the heat production and wear of the first roller bearings 76.

Additionally, in the present embodiment, the first roller bearings 76 partially project into the insertion hole 28. This limits enlargement of the centrifugal compressor 10.

Figure 5:
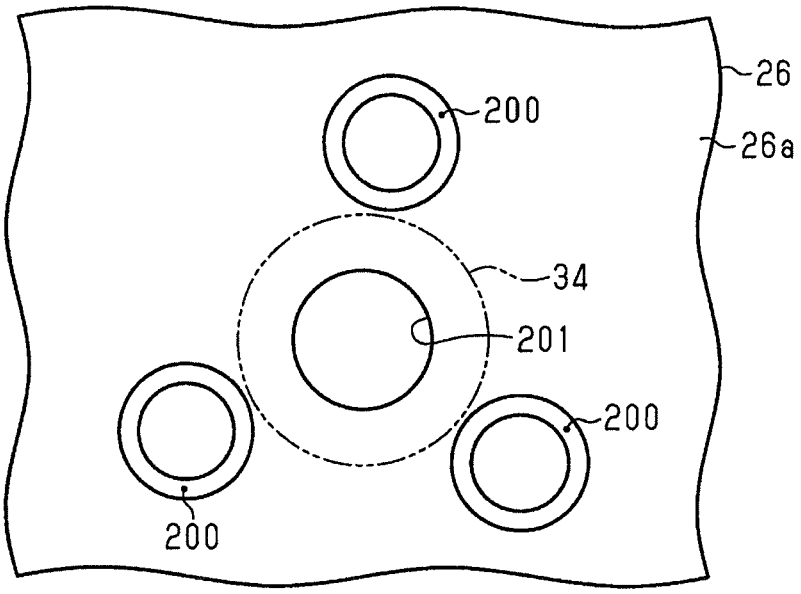
FIG. 5 is a diagram of a cover in which bearing receptacles are separated from an insertion hole.

As shown in FIG. 5, when bearing receptacles 200 are separated from an insertion hole 201, a wall of the cover 26 is provided between the bearing receptacles 200 and the insertion hole 201. The insertion hole 201, shown in FIG. 5, has a smaller diameter than the insertion hole 28 of the embodiment. The size, or diameter, of the seal 34 differs depending on the kind of seal. For example, when a mechanical seal is selected as the seal 34 to ensure the sealability between the speed increaser chamber S2 and the impeller chamber S3, the seal 34 tends to be larger than a lip seal. Also, the diameter of the insertion hole 201 is increased.

In this case, as indicated by the double-dashed line in FIG. 5, if the distance needs to be maintained between each bearing receptacle 200 and the insertion hole 201, the bearing receptacle 200 is located further from the axis of the insertion hole 201 in the radial direction of the roller 71, and the first roller bearing 76 is also located further from the axis of the insertion hole 201. Accordingly, the roller portions 72 need to have larger diameters so that the high-speed shaft 12 contacts the rollers 71. Further, the ring member 62 is enlarged. Enlargement of the ring member 62 causes a decrease in the transmission ratio and also causes enlargement of the speed increaser housing member 23 accommodating the ring member 62, which causes enlargement of the entire centrifugal compressor 10.

As in the present embodiment, when the wall separating the bearing receptacles 90 from the insertion hole 28 is partially removed, the first roller bearings 76 are allowed to partially project into the insertion hole 28. Thus, the first roller bearings 76 will not be located further from the axis of the insertion hole 28 even when the diameter of the insertion hole 28 is increased to enlarge the seal 34.

The above embodiment has the advantages described below.

(1) The oil O flows from the insertion hole 28 into the bearing receptacles 90. This allows the oil O that is supplied to the seal 34 to be supplied to the first roller bearings 76. Thus, a shortage of supply of the oil O to the first roller bearings 76 is limited.

(2) The insertion hole 28 is continuously connected to the bearing receptacles 90. The first roller bearings 76 partially project into the insertion hole 28. This allows the first roller bearings 76 to be located closer to the axis of the insertion hole 28 as compared to when the insertion hole 28 is separated from the bearing receptacles 90 and the first roller bearings 76 do not project into the insertion hole 28. Consequently, the diameter of each roller 71 (diameter of each roller portion 72) does not need to be increased so that the high-speed shaft 12 contacts the roller 71. The speed increaser housing member 23, which accommodates the rollers 71, will not be enlarged. Additionally, a decrease in the transmission ratio that would be caused by enlargement of the ring member 62 will be limited.

(3) A mechanical seal is used as the seal 34. A mechanical seal needs a larger amount of the oil O than a lip seal. Accordingly, a large amount of the oil O is supplied to the first roller bearings 76. This further limits a shortage of supply of the oil O to the first roller bearings 76.

(4) The cover 26 includes the recesses 92 recessed from the bearing receptacles 90 in the thickness-wise direction. The arrangement of the recesses 92 allows the oil O to enter the recesses 92 and further limits a shortage of supply of the oil O to the first roller bearings 76.

The embodiment may be modified as follows.

Instead of a mechanical seal, a different kind of seal, for example, a lip seal, may be used as the seal 34.

The first roller bearings 76 do not have to partially project into the insertion hole 28. In other words, the bearing receptacles 90 do not have to be continuously connected to the insertion hole 28. In this case, the cover 26 includes a communication passage that allows communication between the bearing receptacles 90 and the insertion hole 28. The communication passage connects the insertion hole 28 to the bearing receptacles 90. The oil O is supplied to the bearing receptacles 90 through the communication passage.

The pump does not have to be incorporated in the centrifugal compressor 10 and may be an external pump.

The rollers 71 may be changed in number. For example, the number of the rollers 71 may be four or five. In this case, the number of each of the bearing receptacles 90, the first roller bearings 76, and the second roller bearings 77 is also changed in accordance with the number of the rollers 71.

The diameter of the insertion hole 28 may be constant.

The speed increaser 60 may use a wedge effect. In this case, at least one of the rollers 71 is a movable roller moved by the rotation of the ring member 62.

The centrifugal compressor 10 may be applied to any subject, and the subject compressed by the centrifugal compressor 10 may be any fluid. For example, the centrifugal compressor 10 may be used in an air conditioner, and the fluid that is subject to compression may be a refrigerant. Further, the centrifugal compressor 10 does not have to be installed in a vehicle and may be installed in any subject.

The present examples and embodiments are to be considered as illustrative and not restrictive, and the invention is not to be limited to the details given herein, but may be modified within the scope and equivalence of the appended claims.

What is claimed is:

1. A centrifugal compressor comprising:

a housing;

a ring member accommodated in the housing, wherein the ring member rotates with rotation of a low-speed shaft and includes a circumferential wall;

a high-speed shaft located at an inner side of the circumferential wall and including a flange that extends in a radial direction of the high-speed shaft;

a plurality of rollers located between the circumferential wall and the high-speed shaft;

an impeller that rotates integrally with the high-speed shaft;

a partition that separates an empty space in the housing into a speed increaser chamber and an impeller chamber, wherein the speed increaser chamber accommodates the ring member and the rollers and the impeller chamber accommodates the impeller;

an insertion hole provided in the partition, wherein the high-speed shaft is inserted through the insertion hole;

a seal located in the insertion hole to seal a boundary between the partition and the high-speed shaft;

an oil supply passage located in the housing and having one end open in the insertion hole and configured to supply oil to the seal;

a plurality of pairs of roller bearings, each pair of the roller bearings supports two axial ends of a corresponding one of the rollers; and a plurality of bearing receptacles located in the partition, each of the bearing receptacles accommodates one of a corresponding pair of the roller bearings, and one roller bearing of each of the plurality of pairs of roller bearings partially projects into the insertion hole, wherein the partition includes a communication passage that connects a portion of the insertion hole to the plurality of bearing receptacles to permit oil supplied to the seal to flow from the insertion hole to the plurality of bearing receptacles, the communication passage being located closer to the speed increaser chamber than the seal, the insertion hole includes a large diameter portion and a small diameter portion smaller than the large diameter portion, the seal is provided in the small diameter portion, and the flange is provided in the large diameter portion.

2. The centrifugal compressor according to claim 1, wherein the plurality of bearing receptacles are connected with the insertion hole, the plurality of roller bearings are partially located in the portion of the insertion hole located closer to the speed increaser chamber than the seal, and the communication passage is located in between the plurality of bearing receptacles and the insertion hole.

3. The centrifugal compressor according to claim 1, wherein the seal is a mechanical seal.

4. The centrifugal compressor according to claim 1, wherein the flange opposes the communication passage such that when oil is supplied to the seal the oil flows radially from the at least one flange directly into the plurality of bearing receptacles via the communication passage.

5. The centrifugal compressor according to claim 1, wherein the plurality of bearing receptacles are directly connected to the insertion hole via the communication passage.

6. The centrifugal compressor according to claim 1, wherein the flange is a first flange, and the high-speed shaft includes a second flange that is spaced apart and opposed to the first flange in an axial direction of the high-speed shaft.

7. The centrifugal compressor according to claim 6, wherein the plurality of rollers are held between the first flange and the second flange in the axial direction of the high-speed shaft.

8. The centrifugal compressor according to claim 6, wherein the plurality of bearing receptacles and the plurality of roller bearings are opposed to the first flange and the second flange in the radial direction of the high-speed shaft.

9. The centrifugal compressor according to claim 1, wherein the large diameter portion is closer to the speed increaser chamber than the small diameter portion.

* * * * *